United States Patent [19]

Branz et al.

[11] Patent Number: 4,612,775

[45] Date of Patent: Sep. 23, 1986

[54] REFRIGERATION MONITOR AND ALARM SYSTEM

[75] Inventors: Michael A. Branz, Dunwoody; Paul F. Renuad, Conyers, both of Ga.

[73] Assignee: Kysor Industrial Corporation, Cadillac, Mich.

[21] Appl. No.: 725,124

[22] Filed: Apr. 19, 1985

Related U.S. Application Data

[63] Continuation-in-part of Ser. No. 607,283, May 4, 1984, Pat. No. 4,553,400.

[51] Int. Cl.[4] ..... F25B 49/00

[52] U.S. Cl. ..... 62/126; 62/127; 62/196.4

[58] Field of Search ..... 62/125, 126, 127, 129, 62/131, 117, 196.4, 238.6, DIG. 17; 73/307, 308, 313; 340/623, 624, 625

[56] References Cited

U.S. PATENT DOCUMENTS

| | | | |
|---|---|---|---|
| 2,120,825 | 6/1938 | Wolfert | 62/126 X |
| 2,165,569 | 7/1939 | Obermaier | 62/129 |
| 3,248,895 | 5/1966 | Mauer | 62/196.4 X |
| 4,086,812 | 5/1978 | Luthe et al. | 73/313 X |
| 4,144,521 | 3/1979 | Lehnhert | 340/625 X |
| 4,193,781 | 3/1980 | Vogel et al. | 62/DIG. 17 |
| 4,250,750 | 2/1981 | Martinec et al. | 73/313 X |
| 4,535,603 | 8/1985 | Willitts et al. | 62/196.4 |

*Primary Examiner*—Harry Tanner

*Attorney, Agent, or Firm*—Price, Heneveld, Huizenga & Cooper

[57] ABSTRACT

A refrigerant monitor and alarm includes a sensor positioned to detect the level of liquid state refrigerant in the system and provide an electrical output signal therefrom, a digital display for displaying the refrigerant level, a circuit coupling the digital display to the sensor for actuating the digital display, and a heat reclaim system lockout circuit coupled to the sensor. In a preferred embodiment, the level display is a bar-graph LED-type display incorporated on a control panel also including a refrigerant level alarm and other parameter alarms.

24 Claims, 2 Drawing Figures

REFRIGERATION MONITOR AND ALARM SYSTEM

CROSS-REFERENCE TO RELATED APPLICATION

This application is a continuation-in-part of U.S. patent application Ser. No. 607,283, filed on May 4, 1984, by Michael A. Branz.

BACKGROUND OF THE INVENTION

The present invention relates to a monitor and alarm system for a central refrigeration installation for refrigerated display cases.

In commercial refrigeration installations for supermarkets where a number of refrigerated display cases are employed, typically a plurality of refrigerant compressors are utilized to supply high pressure liquid refrigerant to the evaporators contained in the display cases. Typically, a bank of such compressors will be coupled in parallel between a common input refrigerant manifold and an output manifold which, in turn, is coupled to a receiver containing a mechanical refrigerant liquid level sensor. The evaporators of each refrigerated display case are then commonly coupled to the refrigerant receiver and the outputs of the evaporators return to input manifold completing the refrigerant flow path. Certain refrigeration installations also incorporate a heat reclaiming system, which is used for ancillary heating functions such as room temperature control or heating water. Typically these heat reclaiming systems include a heat exchanger coupled in series to the refrigerant flow path, so that the warmed refrigerant can be selectively diverted or shunted by a valve or valves through the heat reclaiming system as required.

In the past, a mechanical dial-type refrigerant level float was mounted to the receiver to provide a local visual indication of the liquid level. Also, a separate fixed alarm switch, set for approximately 20% of liquid level, was provided to provide an alarm output signal at the fixed level for activating a suitable alarm to the system operator. Systems also typically include oil failure sensing switches at each compressor for detecting the oil level or oil pressure PM in each compressor and a remote panel indicating oil level or pressure PM failures as well as monitoring other functions such as suction and discharge pressures at the input and output manifolds, respectively, and a voltage sensor to detect the loss of any one of the three phase input power employed for powering the compressors.

Thus, although some form of monitoring was provided for some conditions in such a system, the known prior art does not provide an integrated monitoring and alarm system whereby a central panel is provided to display all of the monitored fault functions as well as provide, in addition to the alarm indications, a display of the actual refrigerant level.

Another problem is associated with refrigeration installations incorporating heat reclaiming systems. When the heat reclaim is in operation and refrigerant is diverted therethrough, the level of refrigerant within the remainder of the refrigeration system drops significantly. Thus, the engagement of the heat reclaim system at times when the refrigerant level is already low exacerbates the already undesirable low refrigerant level condition.

SUMMARY OF THE PRESENT INVENTION

Systems embodying the present invention include a sensor positioned to detect the level of liquid state refrigerant in the system and provide an electrical output signal therefrom, a digital display for displaying the refrigerant level, circuit means coupling the digital display to the sensor for actuating the digital display, and a heat reclaim system lockout that is activated upon detection of a preselected low refrigerant level. In a preferred embodiment, the level display is a bar-graph LED-type display incorporated on a control panel also including a refrigerant level alarm and other parameter alarms.

Such a system thereby provides a continuous display to maintenance personnel of the refrigerant liquid level so preventive maintenance can be achieved before an alarm condition exists as well as the other alarm indications all at a convenient, centrally located display panel, as well as preventing the heat reclaim system from exacerbating an already undesirable low refrigerant level condition.

These and other features, objects and advantages of the present invention will become apparent upon reading the following description thereof together with reference to the accompanying drawings in which:

DETAILED DESCRIPTION OF THE PREFERRED EMBODIMENT

Figure 1:
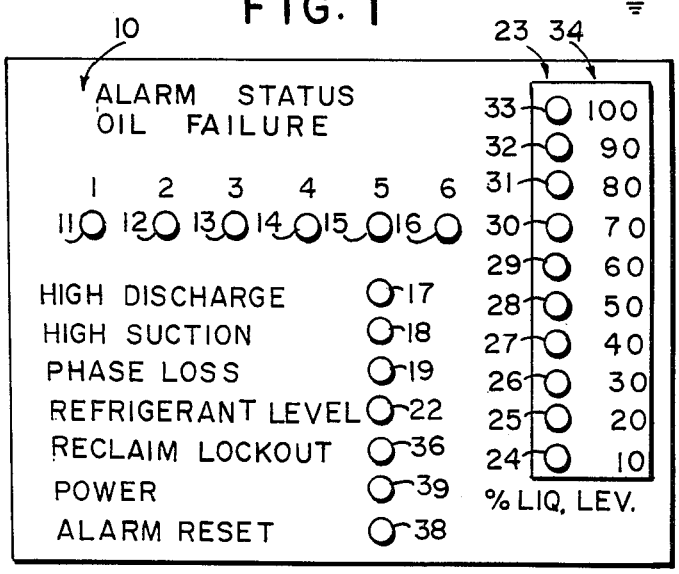
FIG. 1 is a front elevational view of a display panel embodying the system of the present invention.

Referring initially to FIG. 1, there is shown a display panel 10 for the alarm and monitoring system of the present invention. Panel 10 can be located centrally at an installation and remote from the compressors so that it is easily monitored by supervisory or maintenance personnel. The panel 10 includes a horizontal row 20 of six LEDs (light emitting diodes) 11–16, each uniquely associated with one of up to six different compressors. As will be described below, these LEDs indicate for each of up to six compressors in an installation oil levels which fall below a predetermined safe level. Below the row 20 of oil failure indicating LEDs is a high refrigerant discharge pressure LED 17 which is activated when the discharge pressure at the output manifold is excessively high indicating an obstruction in the output refrigerant circuit, air in the refrigerant circuit or condensor fan failure. Below the high discharge LED 17 is a high suction LED indicator 18 which is activated by the electrical circuit, shown in FIG. 2, when the input pressure reaches, for example, 45 psi gauge indicating, for example, a valve problem in the compressor. Below the high suction LED 18 there is a phase loss LED 19 which is coupled to a commercially available phase loss detector for the three phase, 220-volt AC power supplied to the compressors. If any of the three phases are absent due to a power failure, the detector will provide an output signal employed for activating phase loss LED 19.

The remainder of the alarm and monitor system provides a refrigerant alarm level indication as well as a continuously activated refrigerant liquid level display, and also a heat reclaim system lockout indicator. The refrigerant alarm level indication is provided by an LED 22 while the percentage of liquid level is displayed on a display panel 23 including ten vertically aligned and spaced LEDs 24–33 adjacent of which is provided indicia 34 identifying the percentage liquid level present. Indicia 34 is divided, in the preferred embodiment illustrated, in increments of ten percentage points, and as will be described below, the display 23 can be operated as a continuous bar-graph or dot display which is selectable by rear panel control as is the refrigerant alarm level and time delays for the display of selected alarms such as refrigerant level and suction pressure.

Activation of the lockout on the heat reclaim system due to a low refrigerant level is indicated by an LED 36, located beneath refrigerant alarm level LED 22. The front of the display panel 10 also includes an alarm reset switch 38 which can be depressed once an alarm condition is noted and it is desired to deactivate an alarm 60 (FIG. 2) which may be an audible alarm which can be positioned integrally behind the panel or at a remote location. Finally, a power status LED 39 is activated when the refrigeration system is switched on and operational. Having described the display functions provided by the monitor and alarm system, a description of the electrical circuit for the display panel 10 is now described in connection with FIG. 2.

Figure 2:
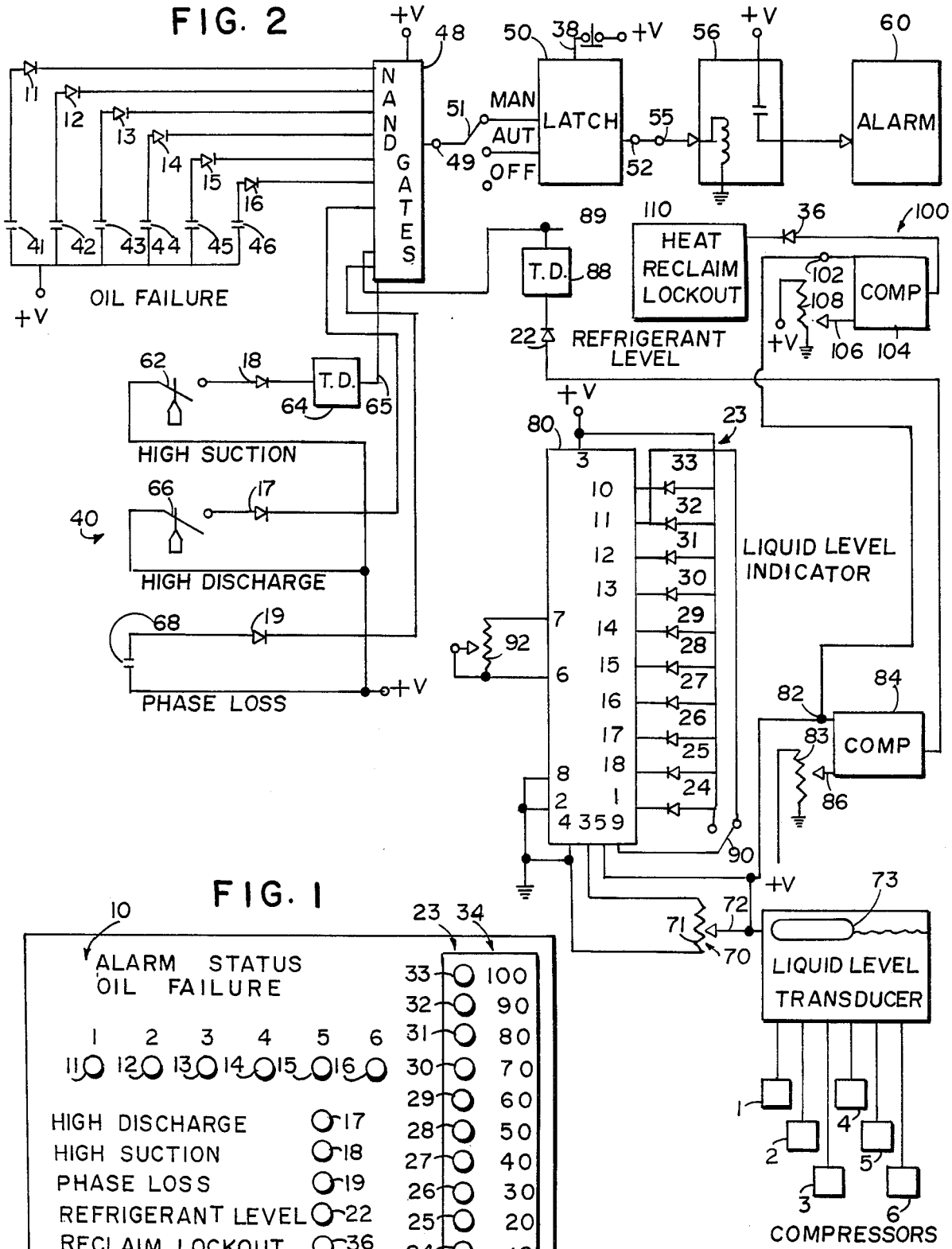
FIG. 2 is a block and schematic electrical circuit diagram of the system embodying the present invention.

Initially, it is noted that circuit 40, shown in FIG. 2, incorporates the LEDs shown on the front panel and which carry the same reference numerals. The oil failure LEDs 11–16 are driven by a low voltage supply +V comprising a 12-volt supply, in the preferred embodiment, through switch contacts 41–46, respectively, of commercially available differential pressure-type-switches. Each of the switch contacts 41–46, therefore, are uniquely associated with compressors 1–6, respectively, and the contacts will close to provide a +V signal at an anode of an associated LED when the oil pressure falls below a predetermined level. The signal on the cathode of one or more activated LED will, therefore, apply a logic "1" signal to one of a plurality of inputs to logic circuit 48.

Circuit 48 is a plurality of NAND gates each having one input grounded, and one input serving as an input to circuit 48. The output of the gates are commonly coupled and coupled to an output terminal 49 of circuit 48 such that a logic "1" at any one of the inputs of circuit 48 will provide a logic "1" output signal at output terminal 49. The output signal, constituting an alarm condition output signal, is applied to a latch circuit 50 by a three-position, single pole switch 51. Switch 51 can be placed in a manual position, as illustrated, by which the latch circuit 50 will respond to the presence of an input logic "1" alarm signal to go into a latched condition providing a relay driving output signal at terminal 52 which remains at a logic "1" condition and is applied to the alarm control relay 56 which, in turn, drives and activates alarm 60. Thus, when a signal on the wiper arm of switch 51 is a logic "1" level due to the existence of any alarm signal applied thereto, when in the manual position, latch 50 will provide a continuous alarm output signal for relay 56 until a reset button switch 38, coupled to the latch, is actuated. Latch 50 can include a standard set-reset flip flop.

When switch 51 is in the automatic or central position, the latching function of circuit 50 is bypassed and the driving signal on switch 51 is applied directly to output terminal 52 which controls relay 56 to actuate the alarm 60 coupled to the output of relay 56 whenever an alarm signal exists. When the alarm signal is discontinued, the system automatically shuts off. When switch 51 is in the off position, the alarm 60 is not activated by the existence of an alarm condition or an associated lighted, LED, however, the LED display is functional to provide a visual indication of an alarm condition on display panel 10.

The high suction LED 18 is similarly activated from the +V source through a pressure actuated switch 62 located in the input manifold of the system to provide a logic output signal at its cathode when a suction pressure of approximately 45 psi gauge is reached. The signal at the cathode of diode 18 is applied to an adjustable time delay circuit 64, which can be set for from 1 to 10 minutes, or other selectable time period if desired, to provide an output signal at output terminal 65 thereof. This signal is, in turn, applied to an input of circuit 48, as illustrated, to provide an alarm signal when high suction pressure is detected after the predetermined selectable delay. The time delay circuit 64 prevents false alarms and may include a clock oscillator and a selectable counter such that the signal from diode 18 will activate the oscillator and counter circuit to provide an output pulse at terminal 65 after a predetermined selectable time period has elapsed from the closure of contact 62. The suction pressure switch 62 is of conventional design and commercially available.

The high discharge LED 17 is similarly coupled to the source of +V through a high discharge pressure switch 66 located in the output manifold of the system and of conventional design and commercially available. Switch 66 closes to provide a signal to the anode of diode 17 when pressures of approximately 250 to 300 psi have been reached indicating a malfunction condition. The cathode of diode 17 is coupled to an input of circuit 48 to provide an alarm signal.

Similarly, the phase loss sensor provides a contact 68 which closes upon loss of any one of the three phases of power supply voltage for any of the compressors in the system and couples a signal through LED 19 to circuit 48 indicating an alarm condition exists.

Thus, any one or more of the oil failure, suction, discharge pressure or phase loss sensors will provide an alarm condition signal through latch 50 to control relay 56 and activate alarm 60. Alarm 60 can be an audible alarm such as a bell or siren or a combination of audio/-visual alarms which can be integrally included on the panel 60 or located remotely at, for example, a supervisor or central control area different than the location of panel 10. Switch 51 typically will be mounted on the back of panel 10 so that the alarm cannot be inadvertently turned off.

The refrigerant liquid level monitoring system employs an analog liquid level transducer 70 comprising a potentiometer 71 coupled to input terminals 3 and 4 of an LM3914 integrated circuit 80 and has a wiper arm coupled to input terminal 5 of the circuit for providing an analog varying DC voltage to circuit 80 representing the level of refrigerant in the receiver. The wiper arm 72 is mechanically coupled to a float 73 to be moved by the float positioned to float within the liquid refrigerant. The sensor thus forms voltage source with the electrical signal at wiper arm 72 coupled to an input terminal 82 of a digital comparator 84 having a reference input terminal 86 coupled to an adjustable reference level voltage source comprising a potentiometer 83 coupled between +V and ground with its wiper arm coupled to input terminal 86 of the comparator. The voltage selected by resistor 83 can be selected such that for any predetermined level of refrigeration, as indicated by the voltage supplied at potentiometer arm 72, will cause comparator 84 to provide a logic "1" output level when the refrigerant level falls below the desired level. The logic "1" signal is applied through the refrigerant alarm level LED 22 to a time delay circuit 88 substantially identical to circuit 64 and having a selectably adjustable alarm delay of from 1 to 60 minutes. Circuit 88 has an output terminal 89 coupled to an input of circuit 48 for providing a signal for activating the alarm 60 when switch 51 is in the manual or automatic modes.

Comparator 84 has a fixed differential, or a fixed plus or minus tolerance for activation, about the selected reference level voltage source at which the logic "1" signal is applied to the alarm circuit. This fixed differential most preferably initiates and then terminates the logic "1" output signal when wiper arm 72 indicates a refrigerant level ranging about the selected alarm level of a plus or minus two percent of full refrigerant level. Thus, for example, if 15% of refrigerant full level is selected as the alarm level, comparator 84 provides a logic "1" output signal and time delay circuit 88 is activated when the refrigerant falls to 13% of full level (i.e., a minus 2% of the 15% alarm level). When the refrigerant level is then raised to 17% of full level (i.e., a plus 2% ), comparator 84 no longer provides the logic "1" signal and time delay circuit 88 is deactivated. This operation can be achieved by providing a positive feedback path and input resistance in comparator 84 coupled in a conventional Schmitt trigger configuration.

Wiper arm 72 is also electrically coupled to output 9 of circuit 80 to provide either a dot or bar-graph display 23 through the LEDs 24–33 having their anodes commonly coupled to the +V supply and their cathodes coupled to the pin numbers indicated in the schematic. A single pole-double throw switch 90 is coupled between pins 9 and 11 of circuit 80 and can be moved into the position shown to provide a dot display for display panel 23. Thus, for example, for a level of 70% of refrigerant, the dot mode would light LED 30 only. If switch 90 is moved to the remaining position commonly coupled to the anodes of the LEDs a level of 70% would activate LEDs 24–30, inclusively. The analog voltage applied to input pin 5 of circuit 80 thus causes the actuation of the level representing LEDs. A calibration potentiometer 92 is coupled between pins 6 and 7, as illustrated in Figure, and is adjusted to provide a 100% scale LED indication when the refrigerant level is at the 100% level.

Thus, with the system of the present invention, a display panel is provided which displays not only alarm conditions but also provides a continuous display of discrete refrigerant liquid levels. The resolution of display 23 can be increased by adding additional circuits 80, if desired, although the 10% increments have been found suitable for commercial refrigeration applications. By providing a sensor 70 which comprises, in the preferred embodiment, a 10 K-ohm precision potentiometer coupled to a float through a gear mechanism such that the full excursion of the pot occurs between the 0 and 100% levels, an analog DC varying voltage representative of the liquid level is provided and can be used to provide a signal for the dual purposes of providing alarm input signal information to comparator 84 as well as a continuous level signal to circuit 80. If desired, a different continuous display other than the discrete LEDs, as for example, a digital numerical display such as an LCD can be provided.

Lockout circuit 100 includes a digital comparator 104 with a reference input terminal 106 coupled to an adjustable reference voltage source comprising a potentiometer 108 coupled between +V and ground, with its wiper arm coupled to input terminal 106 of comparator 104. The remaining input terminal 102 is coupled through input terminal 82, to the variable voltage source provided by the electrical signal at wiper arm 72. The voltage selected by resistor 108 can be adjusted such that for any predetermined level of refrigerant, as indicated by the voltage supplied at potentiometer arm 72, will cause comparator 104 to provide a logic "1" output level when the refrigerant level falls below the desired level. The logic "1" signal is applied through heat reclaim system lockout LED 36 to the heat reclaim system lockout 110. Heat reclaim system lockout 110 includes a conventional valve control which closes a diverter valve to the heat reclaim system upon application of the logic "1" signal in a known manner. The application of the logic "1" signal therefore "locks out" the heat reclaiming system from the remainder of the refrigerant system.

Comparator 104 also has a fixed differential, or a fixed plus or minus tolerance for activation, about the selected reference level voltage source at which the logic "1" signal is applied to the heat reclaim system lockout. This fixed differential most preferably initiates and then terminates the logic "1" output signal when wiper arm 72 indicates a refrigerant level ranging about the selected alarm level of a plus or minus 5% of full refrigerant level. Thus, for example, if 15% of full refrigerant level is selected as the alarm level, comparator 104 provides a logic "1" output signal and heat reclaim system lockout 110 is activated when the refrigerant level falls to 10% of full level (i.e. a minus 5% of the 15% alarm level). When the refrigerant level is thereafter raised to 20% of full level (i.e. a plus 5%), comparator 104 no longer provides the logic "1" signal and heat reclaim system lockout 110 is then deactivated. As with circuit 84 the fixed differential can be achieved by coupling circuit 104 in a Schmitt trigger configuration.

In operation, in an exemplary unit that has been set for a liquid alarm level of 15% of full level, with a 4% total fixed differential (plus or minus 2%) for the alarm time delay, a one hour alarm delay, and a 10% total differential (plus or minus 5%) for the heat reclaim system lockout, when the refrigerant level falls to 13% of full level the one hour time delay is initiated. Thereafter, if the refrigerant level continues to fall, the heat reclaim system will be locked out when the refrigerant level reaches 10% of full level. If the refrigerant level increases, the one hour alarm time delay will be deactivated when the refrigerant level reaches 17% of the full level. However, the lockout of the heat reclaim system will not be released until the refrigerant level rises to 20% of the full level.

These and other modifications to the preferred embodiment will, however, become apparent to those skilled in the art and will fall within the scope and spirit of the invention as defined by the appended claims.

The embodiments of the invention in which an exclusive property or privilege is claimed are defined as follows:

1. A monitor for a refrigeration system including a heat reclaiming system coupled therewith, comprising:

a sensor positioned to detect the level of liquid state refrigerant in the system and provide an electrical output signal therefrom;

a digital display for displaying the refrigerant level;

first circuit means coupling said digital display to said sensor for actuating said digital display; and lockout means coupled with said sensor for deactivating said heat reclaiming system when a preselected refrigerant level is reached.

2. The monitor as defined in claim 1 wherein said lockout means can be adjusted for any desired predetermined level.

3. The monitor as defined in claim 2 wherein said lockout means comprises an adjustable source of reference signals representative of a predetermined refrigerant level, a lockout circuit comparator coupled to said sensor and to said adjustable source and a heat reclaim system deactivation circuit coupled to said lockout circuit comparator.

4. The monitor as defined in claim 3 wherein said digital display comprises an array of discrete LEDs.

5. The apparatus as defined in claim 4 wherein said sensor includes float means coupled to said variable resistor for varying the resistance thereof in response to changes in refrigerant level.

6. The monitor as defined in claim 1 wherein said digital display comprises an array of discrete LEDs.

7. The monitor as defined in claim 6 wherein said circuit means comprises a dot-bar graph display driver.

8. The monitor as defined in claim 7 wherein said array of LEDs are arranged in a single column of vertically spaced LEDs.

9. The monitor as defined in claim 8 wherein said sensor comprises a variable resistor.

10. The apparatus as defined in claim 9 wherein said sensor includes float means coupled to said variable resistor for varying the resistance thereof in response to changes in refrigerant level.

11. The system as defined in claim 1 and further including alarm means coupled to said sensor for providing an alarm when a predetermined refrigerant level is reached.

12. The system as defined in claim 11 wherein said alarm means can be adjusted for any desired predetermined level.

13. The system as defined in claim 12 wherein said alarm means comprises an adjustable source of reference signals representative of a predetermined refrigerant level, an alarm circuit comparator coupled to said sensor and to said adjustable source and an alarm circuit coupled to said alarm circuit comparator.

14. The monitor as defined in claim 13 wherein said lockout means can be adjusted for any desired predetermined level.

15. The monitor as defined in claim 14 wherein said lockout means comprises an adjustable source of reference signals representative of a predetermined refrigerant level, a lockout circuit comparator coupled to said sensor and to said adjustable source and a heat reclaim system deactivation circuit coupled to said lockout circuit comparator.

16. A monitor and alarm system for a refrigeration system including a plurality of compressors, and including a heat reclaiming system coupled therewith, said system comprising:

means for sensing the refrigerant level for said compressors and providing an electrical output signal representing the level of the refrigerant;

means coupled to said sensing means for displaying the refrigerant level at a location remote from the refrigerant supply;

means for providing an adjustable reference signal representing a selectable predetermined refrigerant level;

alarm circuit comparator means coupled to said sensing means and said providing means for providing an alarm output signal when the refrigerant level reaches a preset level;

alarm means coupled to said alarm circuit comparator means and responsive to said alarm output signal to provide an alarm indicating a refrigerant level below a predetermined selected level;

lockout circuit comparator means coupled to said sensing means and said providing means for providing a lockout output signal when the refrigerant level reaches a preset level; and lockout means coupled to said lockout circuit comparator means and responsive to said lockout output signal to deactivate said heat reclaiming system.

17. The system as defined in claim 16 wherein said lockout circuit comparator means provides a differential for initiation and for termination of said lockout output signal about said preset level.

18. The system as defined in claim 17 wherein said alarm output signal is provided at a refrigerant level higher than the refrigerant level at which said lockout output signal is provided.

19. The system as defined in claim 18 wherein said displaying means is a digital display.

20. The system as defined in claim 19 wherein said digital display comprises an array of discrete LEDs

21. The system as defined in claim 20 wherein said array of LEDs are arranged in a single column of vertically spaced LEDs.

22. The system as defined in claim 21 wherein said displaying means includes a dot-bar graph driver coupled between said sensing means and said LEDs.

23. The system as defined in claim 22 wherein said sensing means comprises a variable resistor.

24. The system as defined in claim 23 wherein said sensing means includes float means coupled to said variable resistor for varying the resistance thereof in response to changes in refrigerant level.

* * * * *